US011227570B1

(12) United States Patent
Corbitt

(10) Patent No.: US 11,227,570 B1
(45) Date of Patent: Jan. 18, 2022

(54) DRUMSTICK HOLDER DEVICE AND METHOD

(71) Applicant: Phillip Corbitt, Gardnerville, NV (US)

(72) Inventor: Phillip Corbitt, Gardnerville, NV (US)

( * ) Notice: Subject to any disclaimer, the term of this patent is extended or adjusted under 35 U.S.C. 154(b) by 0 days.

(21) Appl. No.: 17/146,435

(22) Filed: Jan. 11, 2021

(51) Int. Cl.
*G10D 13/12* (2020.01)

(52) U.S. Cl.
CPC ..... *G10D 13/12* (2020.02)

(58) Field of Classification Search
CPC ..... G10D 13/12; G10D 3/00
See application file for complete search history.

(56) References Cited

U.S. PATENT DOCUMENTS 9,564,113 B2 * 2/2017 Bradfield ..... G10G 5/00

* cited by examiner

*Primary Examiner* — Kimberly R Lockett
(74) *Attorney, Agent, or Firm* — Fish & Richardson P.C.

(57) ABSTRACT

An improved drumstick holder device allowing for two drumsticks to be held and manipulated by a single hand.

12 Claims, 2 Drawing Sheets

DRUMSTICK HOLDER DEVICE AND METHOD

TECHNICAL FIELD

This disclosure relates to a drumstick holder device, and in some implementations, a drumstick holder for retaining two drumsticks in a single hand and its method of use.

BACKGROUND

Drumsticks are a useful device for playing musical instruments such as the drums and other percussion devices. Drumsticks typically comprise a shaft with a tip or bead at one end used to strike a musical instrument. Although commonly wood, drumsticks may also be made of other materials, such as plastic or nylon. In use, a musician will usually hold one drumstick in each hand and use them to strike a percussion instrument. As such, a musician is usually limited in the sounds they can produce by the speed at which they can move each hand, either to repeatedly strike the same percussion device, to switch positions on a percussion device, or to switch between percussion devices. Although there are certain techniques for grasping multiple drumsticks in a single hand, these are often not ergonomically comfortable or may impede the musician's ability to provide a sufficient striking force with each individual drumstick.

SUMMARY

Some embodiments described herein include an improved drumstick holder device that secures multiple drumsticks, wherein the drumstick holder device is designed to be held and used with a single hand. In some embodiments, the improved drumstick holder device may comprise a textured gripping surface for holding the device securing during use. The drumstick holder device may further optionally include a plurality of drumstick cavities exposed on one end that are sized to frictionally secure a plurality of drumsticks. The plurality of drumstick cavities may optionally be sized at different depths in different embodiments so as to provide varying levels of "bounce" between the drumsticks and the drumstick holder device during use, which may provide different acoustical qualities.

In some embodiments, the drumstick cavities in the drumstick holder device may be oriented parallel to each other, such that a plurality of drumsticks would extend parallel from the drumstick holder device during use. In other embodiments, the drumstick cavities may be oriented with their respective central axes at an angle to one another, such as an angular offset of 30-degrees, so as to advantageously allow a musician to strike different parts of an instrument (e.g. both sides of a high-hat on a drum kit) using a single hand movement.

Optionally, the improved drumstick holder device may be constructed from an elastomeric material, such as silicone or rubber. In some embodiments, this allows the drumstick cavities to be sized smaller than a traditional drumstick so that the cavities may elastically deform around the drumsticks and provide a frictional retaining force to reduce the likelihood of the drumsticks inadvertently falling from the drumstick holder device, particularly during aggressive playing. Silicone or other elastomeric materials may also advantageously provide a vibration dampening effect between the drumsticks and the musician's hand during use. Further, silicone or other elastomeric materials may provide a gripping surface to the musician operating the improved drumstick holder that is less slippery and provides a firmer grip than certain other materials.

Particular embodiments described herein include a drumstick holder comprising an elastomeric body having a first end, a second end opposite from the first end, and an exterior handgrip positioned between the first end and the second end. Optionally, some embodiments may comprise a plurality of drumstick cavities defined by the elastomeric body and having an elongate shape extending for a drumstick cavity length from the second end towards the first end within the elastomeric body. In particular implementations, each drumstick cavity length is sized to receive a maximum of less than half of a standard drumstick such that a majority length of each standard drumstick is exposed exteriorly of the elastomeric body when each standard drumstick is fully seated within a corresponding one of the drumstick cavities.

Some embodiments described herein may comprise a system for holding a plurality of drumsticks in a single hand, comprising a drumstick holder having an elastomeric body having a first end, a second end opposite from the first end, and an exterior handgrip positioned between the first end and the second end, and a plurality of drumstick cavities defined by the elastomeric body and having an elongate shape extending for a drumstick cavity length from the second end towards the first end within the elastomeric body. Optionally, in some embodiments each drumstick cavity length is sized to receive a maximum of less than half of a standard drumstick such that a majority length of each standard drumstick is exposed exteriorly of the elastomeric body when each standard drumstick is fully seated within a corresponding one of the drumstick cavities. In some implementations, the system further comprises a plurality of drumsticks, wherein each of the plurality of drumsticks is inserted into one of the drumstick cavities.

Some embodiments described herein include a method of striking a percussion instrument with a plurality of drumsticks held in a single hand. In some embodiments, the method may include the step of grasping with the single hand an exterior handgrip of a drumstick holder having an elastomeric body, wherein the elastomeric body has a first end, a second end opposite from the first end, a plurality of drumstick cavities defined by the elastomeric body and having an elongate shape extending from the second end towards the first end within the elastomeric body, and the exterior handgrip is positioned between the first end and the second end. Optionally, the method may further include the step of striking a percussion instrument with a plurality of drumsticks, wherein each drumstick is inserted into one of the plurality of drumstick cavities, wherein each drumstick cavity length is sized to receive a maximum of less than half of the drumstick such that a majority length of each drumstick is exposed exteriorly of the elastomeric body when each drumstick is fully seated within a corresponding one of the drumstick cavities.

A number of embodiments described herein may provide one or more of the following advantages. First, some embodiments provide a drumstick holder device for retaining a plurality of drumsticks such that the plurality of drumsticks may be held and used by a single hand while striking a musical instrument. For example, the improved device can allow a musician to strike a percussion instrument more quickly or with other acoustic dynamics that would be challenging to achieve by a single drumstick or by comfortably gripping two drumsticks with a single hand alone. Second, the improved drumstick holder device may allow a musician to strike two different instruments or two different parts of one instrument simultaneously with sufficient force to provide a desired sound. Third, the improved drumstick holder device may be constructed of silicone or another pliable elastomeric material to provide a textured gripping surface that allows for both an increased grip and a comfortable playing with less vibration transmitted to the musician's hands during use.

The details of one or more embodiments are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Figure 1:
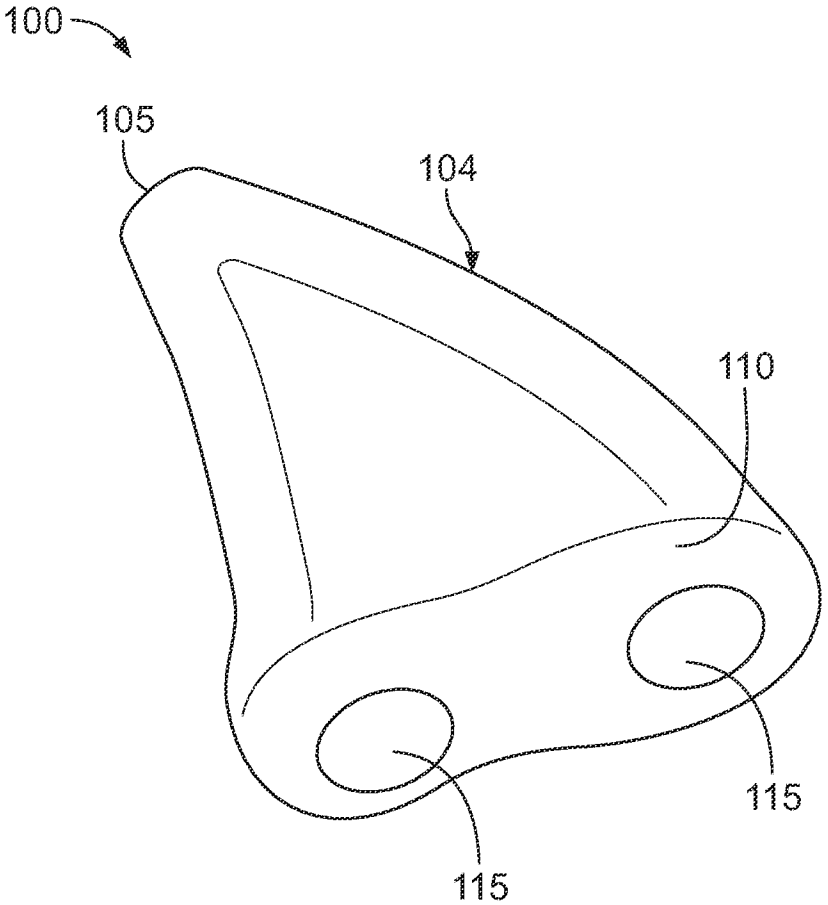
FIG. 1 shows a perspective view of an improved drumstick holder device.

Referring now to FIG. 1, an embodiment of an improved drumstick holder device 100 is shown. The improved drumstick holder device 100 may have a first end 105 and a second end 110. Optionally, improved drumstick holder device 100 may be wider at second end 110 than at first end 105 and tapered between the two ends, so as to provide an ergonomic position for a musician's hand to grip drumstick holder device 100. In some embodiments, first end 105 is tapered to a point, whereas in other embodiments first end 105 is tapered but retains a width at its narrowest point. In particular implementations, the length from first end 105 to second end 110 is greater than the maximum width of drumstick holder device 100.

In some embodiments, improved drumstick holder device 100 may further comprise an exterior handgrip 104, which may optionally include a textured gripping surface (not shown) between first end 105 and second end 110. In other embodiments, exterior handgrip 104 of improved drumstick holder device 100 may optionally include cut outs or depressions sized to accommodate a musician's fingers (also not shown). In some implementations, exterior handgrip 104 is formed by texturing the surface of drumstick holder device 100. In other implementations, exterior handgrip 104 may be a separate gripping surface affixed to drumstick holder device 100.

In some embodiments, improved drumstick holder device 100 may be construed from a single piece of elastomeric material, such as rubber or silicone. Such materials may provide a pliable surface that is easy for a musician to hold while providing a dampening effect to vibrations from drumsticks. Such vibrations may be unpleasant, particularly after longer sessions of playing the drums. In yet other embodiments, improved drumstick holder device 100 may be constructed from other resilient materials, or may be constructed from multiple pieces, rather than a single piece.

As shown in FIG. 1, some embodiments of improved drumstick holder device 100 may include a plurality of elongate drumstick cavities 115 proximate second end 110 and extending from second end 110 to first end 105. Optionally, each of the drumstick cavities 115 can be defined by drumstick holder device 100 as cylindrical cavity having a diameter that is selected to achieve a frictional engagement with a drumstick when the drumstick is pressed into the cavity 115. In other embodiments, drumstick cavities 115 may be of other shapes, such as a rectangular, hexagonal, or other cross-sectional shape as opposed to circular.

Drumstick cavities 115 may optionally be sized to each receive and retain a drumstick (FIG. 3) therein. In some embodiments, drumstick cavities 115 are sized to accommodate a standard drumstick. As used herein, the term "standard drumstick" means a percussion mallet comprising a butt, shaft, shoulder and tip with an overall length between 15.5 and 18 inches and a diameter between 0.4 and 0.65 inches.

In some embodiments, drumstick cavities 115 may extend a portion of the distance between second end 110 and first end 105, or in other embodiments drumstick cavities 115 may extend all of the way from second end 110 to first end 105. In some embodiments, drumstick cavities 115 have a cavity length sized to receive a maximum of less than half of a drumstick such that a majority length of each drumstick is exposed exteriorly of the drumstick holder device 100 when each drumstick is fully seated within a corresponding one of the drumstick cavities.

In particular embodiments, such as when drumstick holder device 100 is constructed from a resilient material like silicone or another elastomeric material, drumstick cavities 115 may be sized more narrow than the drumstick so that each of drumstick cavities 115 will stretch around the drumstick (when inserted therein) in order to releasably and frictionally secure the drumstick within drumstick holder device 100. In other embodiments, clips or clamps (not shown) may be used to secure a drumstick within one of drumstick cavities 115. Although FIG. 1 shows two drumstick cavities 115, other embodiments may have three or more drumstick cavities 115 for accommodating additional drumsticks.

Still referring to FIG. 1, may be placed at an angle to one another with respect to drumstick holder device 100. For example, drumstick cavities 115 may be oriented at an angle approximately 30 degrees from one another, although other orientations up to 90 degrees are possible as well. In other embodiments, drumstick cavities 115 may be oriented parallel to one another. In some embodiments, improved drumstick holder device 100 may include a hinged connector (not shown) between drumstick cavities 115 and the remainder of drumstick holder device 100, such that a musician may select and adjust the orientation of drumstick cavities 115 with respect to one another.

Figure 2:
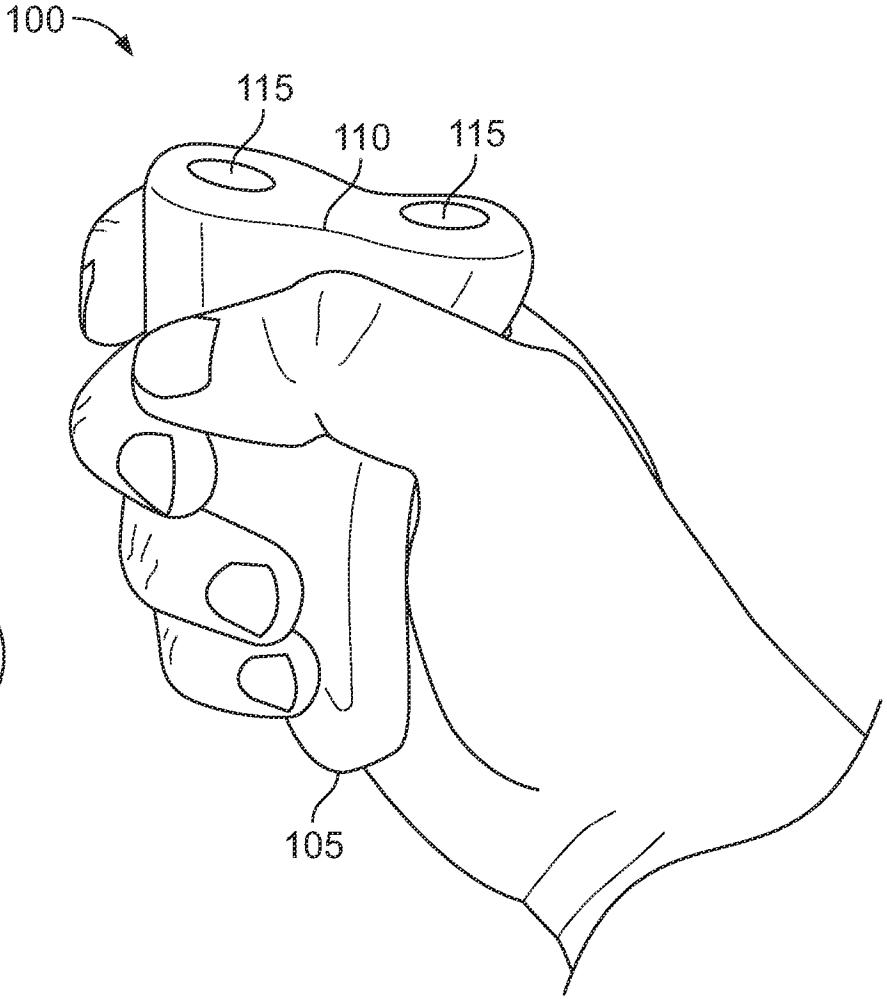
FIG. 2 shows an alternative perspective view of FIG. 1 including a hand gripping the improved drumstick holder device.

Referring now to FIG. 2, drumstick holder device 100 of FIG. 1 is shown with a musician's hand gripping improved drumstick holder device 100. In some embodiments, improved drumstick holder device 100 may include depressions for a user's fingers to grip the device. In other embodiments, such as shown in FIG. 2, improved drumstick holder device 100 may omit such depressions so that improved drumstick holder device 100 may be held in either the user's left or right hand.

Figure 4:
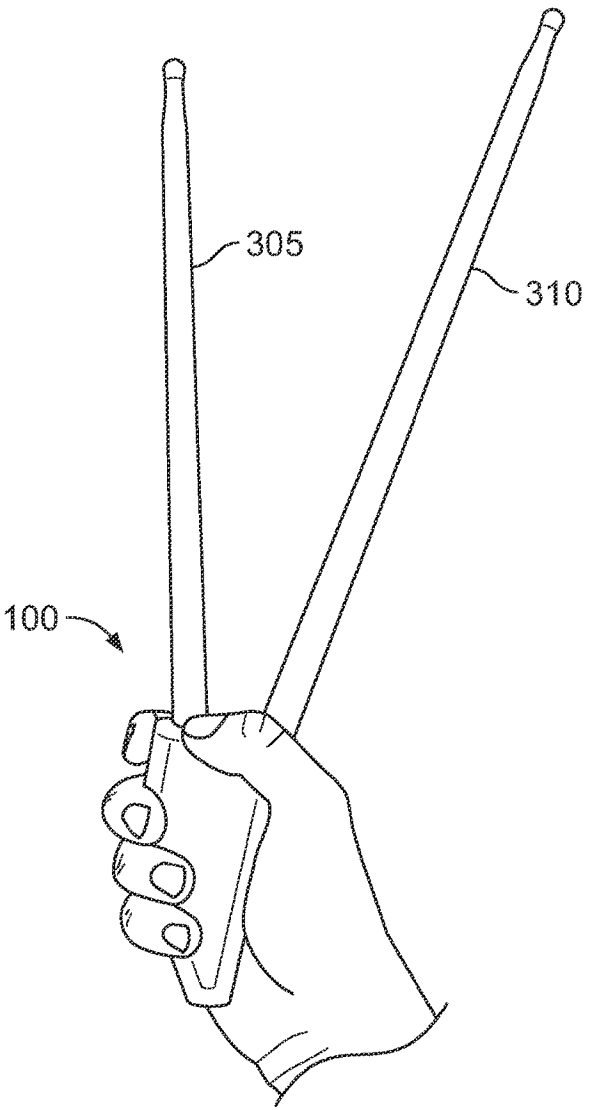
FIG. 4 shows improved drumstick holder device of FIG. 3 including a hand gripping the improved drumstick holder device.
Figure 3:
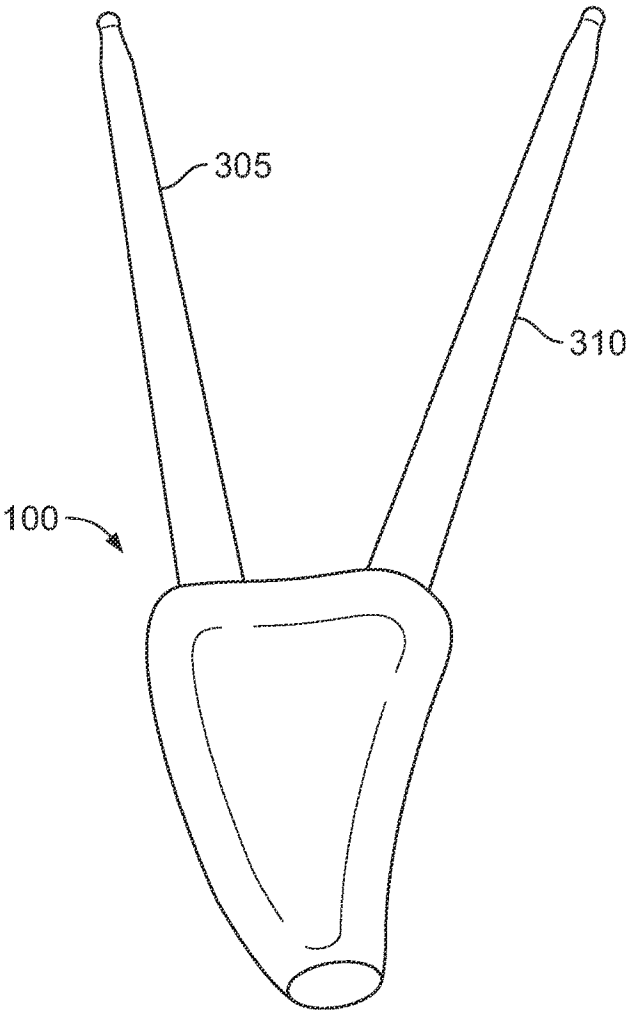
FIG. 3 shows an alternative perspective view of FIG. 1 with drumsticks inserted into the improved drumstick holder device.

Turning now to FIG. 3, drumstick holder device 100 is shown with drumsticks 305 and 310 inserted into drumstick cavities 115. FIG. 4 shows the improved drumstick holder 100 of FIG. 3 with a musician's hand gripping improved drumstick holder device 100.

In use, the embodiments of drumstick holder device 100 depicted in FIGS. 1-4 can be used by a musician to hold a plurality of drumsticks and strike a percussion instrument.

In one example, during operation, a user may place a first drumstick 305 into a first drumstick cavity 115. The user may then optionally insert a second drumstick 310 into another of cylindrical cavity 115. In some embodiments, the user may then grasp both drumsticks in a single hand by gripping exterior handgrip 104. The user may then use improved drumstick holder device 100 to strike a drum or other percussion instrument with one or both of drumsticks 305 and 310.

A number of embodiments have been described. Nevertheless, it will be understood that various modifications may be made without departing from the scope of the following claims.

What is claimed is:

1. A method of striking a percussion instrument with a plurality of drumsticks held in a single hand comprising:

grasping with the single hand an exterior handgrip of a drumstick holder having an elastomeric body, wherein the elastomeric body has a first end, a second end opposite from the first end, a plurality of drumstick cavities defined by the elastomeric body and having an elongate shape extending from the second end towards the first end within the elastomeric body, and the exterior handgrip is positioned between the first end and the second end;

striking a percussion instrument with a plurality of drumsticks, wherein each drumstick is inserted into one of the plurality of drumstick cavities, wherein each drumstick cavity length is sized to receive a maximum of less than half of the drumstick such that a majority length of each drumstick is exposed exteriorly of the elastomeric body when each drumstick is fully seated within a corresponding one of the drumstick cavities.

2. The method of claim 1, wherein each drumstick is a standard drumstick.

3. The method of claim 1, wherein the plurality of drumstick cavities comprises a first cylindrical cavity and a second cylindrical cavity.

4. The method of claim 3, wherein the first and second cylindrical cavities are substantially parallel to each other.

5. The method of claim 3, wherein a central axis of the first cylindrical cavity is oriented 30 degrees from a central axis of the second cylindrical cavity.

6. The method of claim 3, wherein the first and second cylindrical cavities extend from the second end toward the first end.

7. The method of claim 3, wherein the first and second cylindrical cavities extend between 25% and 75% of a maximum length between the second end to the first end.

8. A system for holding a plurality of drumsticks in a single hand, comprising:

a drumstick holder having an elastomeric body having a first end, a second end opposite from the first end, and an exterior handgrip positioned between the first end and the second end, and a plurality of drumstick cavities defined by the elastomeric body and having an elongate shape extending for a drumstick cavity length from the second end towards the first end within the elastomeric body, wherein each drumstick cavity length is sized to receive a maximum of less than half of a standard drumstick such that a majority length of each standard drumstick is exposed exteriorly of the elastomeric body when each standard drumstick is fully seated within a corresponding one of the drumstick cavities; and a plurality of drumsticks, wherein each of the plurality of drumsticks is inserted into one of the drumstick cavities.

9. The system of claim 8, wherein each of the plurality of drumsticks is a standard drumstick.

10. The system of claim 8, wherein the plurality of drumstick cavities comprises a first cylindrical cavity and a second cylindrical cavity.

11. The system of claim 10, wherein the first and second cylindrical cavities are substantially parallel to each other.

12. The system of claim 10, wherein a central axis of the first cylindrical cavity is oriented 30 degrees from a central axis of the second cylindrical cavity.

* * * * *